US006900170B2

(12) United States Patent
Instone et al.

(10) Patent No.: US 6,900,170 B2
(45) Date of Patent: May 31, 2005

(54) GRANULAR COMPOSITION

(75) Inventors: Terry Instone, Wirral (GB); Rafiq Mohammed Nabi, Wirral (GB); John Edley Wilson, Wirral (GB)

(73) Assignee: Unilever Home Products and Care USA, a division of Conopco, Inc., Greenwich, CT (US)

( * ) Notice: Subject to any disclaimer, the term of this patent is extended or adjusted under 35 U.S.C. 154(b) by 252 days.

(21) Appl. No.: 10/145,011

(22) Filed: May 14, 2002

(65) Prior Publication Data

US 2003/0050217 A1 Mar. 13, 2003

(30) Foreign Application Priority Data

May 15, 2001 (GB) ..... 0111863

(51) Int. Cl.[7] ..... C11D 17/00

(52) U.S. Cl. ..... 510/443; 510/441; 510/444; 510/446

(58) Field of Search ..... 510/441–446, 510/356, 507

(56) References Cited

U.S. PATENT DOCUMENTS

| | | | | |
|---|---|---|---|---|
| 3,868,336 | A | 2/1975 | Mazzola et al. | 252/524 |
| 4,675,124 | A | 6/1987 | Seiter et al. | 252/91 |
| 5,514,295 | A | 5/1996 | Flower | 252/174 |
| 5,516,447 | A | 5/1996 | Bauer et al. | 252/89.1 |
| 5,578,561 | A | 11/1996 | Sakamoto et al. | 510/349 |
| 5,591,707 | A | 1/1997 | Raehse et al. | 510/451 |
| 5,610,131 | A | 3/1997 | Donoghue et al. | 510/444 |
| 5,654,265 | A | 8/1997 | Kuroda | 510/507 |
| 5,736,501 | A | 4/1998 | Yamashita et al. | 510/444 |
| 6,340,662 | B1 * | 1/2002 | Millhoff et al. | 510/417 |

FOREIGN PATENT DOCUMENTS

| | | | |
|---|---|---|---|
| CA | 2 308 932 | | 5/2000 |
| CA | 2 308910 | | 11/2000 |
| DE | 19857204 A1 | * | 6/2000 |
| EP | 265 203 | | 4/1988 |
| EP | 0 354 331 | | 2/1990 |
| EP | 521 635 | | 1/1993 |
| EP | 544 365 | | 6/1993 |
| EP | 622 454 | | 11/1994 |
| EP | 648 259 | | 4/1995 |
| EP | 694 608 | | 1/1996 |
| EP | 0 799 884 | | 10/1997 |
| EP | 1 085 080 | | 3/2001 |
| GB | 1 578 288 | | 11/1980 |
| WO | 92/06150 | | 4/1992 |
| WO | 94/09109 | | 4/1994 |
| WO | 97/32952 | | 9/1997 |
| WO | WO 98/01520 | * | 1/1998 |
| WO | WO 98/09701 | * | 3/1998 |
| WO | 98/11198 | | 3/1998 |
| WO | 99/46359 | | 9/1999 |
| WO | WO 00/36063 | * | 6/2000 |

OTHER PUBLICATIONS

Grand and hackh's Chemical Dictionary, fifth edition, 1987 Mc Graw–Hill, Inc. p. 422.*

PCT International Search Report in a PCT application PCT/EP 02/05091.

PCT International Search Report in a PCT application PCT/EP 02/05076.

Derwent Abstract of EP 0 354 331—published Feb. 14, 1990.

Patent Abstracts of Japan, JP 08–027498—published Jan. 30, 1996.

Co–pending Application: Garrett et al., U.S. Appl. No. 10/144,995; Filed: May 14, 2002.

* cited by examiner

*Primary Examiner*—Margaret Einsmann
(74) *Attorney, Agent, or Firm*—Rimma Mitelman

(57) ABSTRACT

In order to improve the dispersion of nonionic surfactant into wash water from a granule in which the nonionic surfactant is carried on a water-insoluble granular material, the nonionic surfactant is intimately blended with a water-insoluble liquid. Preferred water-insoluble liquids include hydrocarbons, for example, paraffins.

28 Claims, No Drawings

GRANULAR COMPOSITION

TECHNICAL FIELD

The present invention relates to nonionic-surfactant-containing granular compositions, for use in particulate laundry detergent compositions.

BACKGROUND AND PRIOR ART

It is frequently desired to include nonionic surfactant in granular laundry detergent compositions as it gives good oily soil detergency and can reduce foam levels, which is beneficial in detergent compositions for use in automatic washing machines.

Nonionic surfactant may be introduced into granular detergent compositions during the manufacture thereof along with other components such as anionic surfactants, builders etc. manufacturing requirements can place an upper limit to the amount of nonionic surfactant which can be included.

Detergent compositions with relatively high quantities of nonionic surfactant may be required as detergent compositions in their own right or for dosing to other detergent compositions to increase the proportion of nonionic surfactant in the combined composition.

The present application relates both to the inclusion of nonionic surfactant in fully formulated granular compositions and to nonionic-surfactant-containing granular compositions with high nonionic content for dosing to other detergent compositions.

Nonionic-surfactant-containing particles are disclosed for example in JP 08 027 498A (Kao), which discloses a silica based carrier having an oil absorption capacity of at least 80 ml/g and capable of providing a particle having up to 50% by weight of nonionic surfactant.

EP 521 635A (Unilever) discloses the use of zeolite P having a silicon to aluminium ratio not greater than 1.33 (otherwise called zeolite MAP) as a carrier for liquid, viscous-liquid, oily or waxy detergent ingredients such as nonionic surfactant. The zeolite MAP can be used in the form of a powder, granulate or as a component of a detergent composition.

Problems are now being experienced with the rate of dissolution of nonionic surfactant from granulates comprising nonionic surfactant absorbed in a carrier, referred to herein as dispersion. In particular, problems have been encountered such as poor dispersion of the powder into the wash water in the dispenser drawer of an automatic washing machine. A gritty, viscous mass may remain in the dispenser drawer. Further, powder compositions entrained in the wash water may not break-up and disperse adequately. Undispersed particles of powder compositions may remain in the wash water. These can adhere to clothes and cause local damage. Undissolved powder composition can remain on the clothes after washing. There are particular dispersion problems where nonionic surfactant is absorbed onto carrier particles comprising a high proportion of aluminosilicate.

Addition of oils to powdered detergents as hydrophobing agents, thus aiding dispensing is disclosed in EP 0648 259 (Henkel).

U.S. Pat. No. 5,514,295 (Amway/Flower) discloses granular detergent compositions comprising a detergent (base) powder to which a liquefied intimate mixture of a nonionic surfactant, a fatty acid and a fatty alcohol is applied.

EP 694 608A (Procter & Gamble) discloses a premix of a specific nonionic surfactant (polyhydroxy fatty acid amide, glucamide) with a glyceride as a structurant. The premixes may also contain ethoxylated nonionic surfactant.

CA 2308932 (Henkel) discloses a process for the production of surfactant granules in which nonionic surfactant and polyalkylene glycol are premixed.

GB 1,578,288 (Colgate-Palmolive) discloses a detergent composition mainly for formation into solid pellets comprising a water-soluble soap component, a water soluble synthetic detergent component (anionic or nonionic surfactant) and a solvent component (which is a mixture of water soluble and non-water soluble solvents). Addition of further components including builders (zeolites and phosphates) is described.

The present inventors have now found that the rate of dissolution of nonionic-surfactant-containing granular compositions can be improved if the nonionic surfactant is intimately blended with a water-insoluble liquid, before preparing the granular composition.

DEFINITION OF THE INVENTION

In a first aspect, the present invention provides a nonionic-surfactant-containing granular composition, comprising:

(a) from 5 to 60 wt % of an intimate blend of
  (i) a nonionic surfactant, and
  (ii) a water-insoluble liquid selected from hydrocarbons, paraffins, aromatic solvents, halogenated solvents, heterocyclic solvents, terpenes, mineral oils and silicone oils, wherein the weight ratio of the nonionic surfactant (i) to the water-insoluble liquid (ii) is within the range of from 5:1 to 1:2, and (b) from 40 to 95 wt % of a granular carrier material.

In a second aspect of the invention, there is provided a process for manufacturing the nonionic-surfactant-containing granular composition defined above, which process comprises:

(i) blending a nonionic surfactant with a water-insoluble liquid to produce an intimate blend, followed by
(ii) absorbing the intimate blend onto a granular carrier material.

In a third aspect, the present invention provides a particulate laundry detergent composition comprising from 5 to 60 wt % of surfactant, from 10 to 80 wt % of detergency builder and optionally other detergent ingredients, the composition being in the form of at least two particulate or granular components of which at least one is a nonionic-surfactant-containing granular composition as defined previously.

DETAILED DESCRIPTION OF THE INVENTION

Nonionic-Surfactant-Containing Granular Composition

The nonionic-surfactant-containing granular composition suitably comprises from 5 to 60 wt %, preferably from 20 to 50 wt %, of the intimate blend of nonionic surfactant and water-insoluble liquid, and from 40 to 95 wt %, preferably from 50 to 80 wt %, of the granular carrier material.

The ratio of nonionic surfactant to water-insoluble liquid is within the range of from 5:1 to 1:2 by weight. Preferably, they are present at a ratio within the range of from 4:1 to 1:1.

Other minor ingredients such as water may be present at a level of preferably less than 5% by weight.

The granular composition of the present invention preferably has a bulk density in the range of from 400 to 1200 g/l.

The $d_{50}$ particle size is preferably in the range of from 200 to 1000 micrometres. The quantity $d_{50}$ indicates that 50 wt % of the particles have a diameter smaller than that figure. Particle size may be measured by any suitable method. For the purposes of the present invention particle sizes and distributions were measured using a Malvern Mastersizer (Trade Mark).

The Water-Insoluble Liquid

The nonionic surfactant contains an additional component, herein referred to as the water-insoluble liquid. It is an essential element of the invention that the water-insoluble liquid is soluble in the nonionic surfactant and is intimately mixed therewith to provide an intimate blend. The water-insoluble liquid is included to improve the dissolution into water of the nonionic surfactant from the granular carrier material.

Without wishing to be bound by theory, it is believed that nonionic surfactant such as ethoxylated nonionic surfactant dissolves relatively slowly in wash water due to the formation of viscous mesophases. It is believed that the water-insoluble liquid acts as a phase behaviour modifier when intimately mixed with the nonionic surfactant, leading to improved dissolution in water.

The water insoluble liquid is immiscible with water, but at the same time is miscible with the nonionic surfactant. Such materials will tend to have a low polarity and preferably would form a high energy interface with water. The liquid is selected from hydrocarbons, paraffins, aromatic solvents, halogenated solvents, heterocyclic solvents, terpenes, mineral oils and silicone oils. Preferably the water insoluble liquid is a hydrocarbon and/or an oil.

Preferred classes of water-insoluble liquids are linear chain paraffins, branched chain paraffins and mixtures thereof.

Preferably, the intimate blend consists essentially of water-insoluble liquid and nonionic surfactant only. In particular, other surfactant types including anionic surfactants and soaps are preferably absent. Further, water soluble solvents are absent and preferably all non-surfactant water soluble liquids are absent.

The Granular Carrier Material

The granular carrier material must be capable of carrying the surfactant/water-insoluble liquid blend by absorption and/or adsorption. Thus the carrier material suitably has intraparticulate or interparticulate porosity.

Although it is not essential to the invention, it is preferred that the carrier material is substantially or completely water-insoluble.

Preferred carrier materials are crystalline alkali metal aluminosilicates (zeolites), and according to one preferred embodiment of the invention the granular carrier material comprises at least 76 wt %, preferably at least 80 wt %, alkali metal aluminosilicate. Most preferably the granular carrier material consists essentially of alkali metal aluminosilicate.

Aluminosilicates are materials having the general formula:

$$0.8\text{–}1.5\ M_2O.Al_2O_3.0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature. Preferred zeolites are zeolite MAP and zeolite A and mixtures thereof.

As alternatives to zeolites, other preferred granular carrier materials include the following:

silicas of appropriate oil absorption capacity calcite insoluble silicates clays The granular carrier material may suitably comprise lesser amounts of additional components. Examples of such components are salts which have building properties, for example sodium carbonate, optionally combined with a calcite seed, sodium tripolyphosphate, layered silicates, for example SKS-6 (Trade Mark), amorphous aluminosilicate, organic builders such as polycarboxylate polymers, monomeric polycarboxylate such as citrate or mixtures thereof. The granular carrier material may also comprise non-builder solid materials such as sodium sulphate or sodium bicarbonate.

Nonionic Surfactant

Nonionic surfactants that may be used include the primary and secondary alcohol ethoxylates, especially $C_8$–$C_{20}$ primary and secondary aliphatic alcohols ethoxylated with an average of from 1 to 20 moles of ethylene oxide per mole of alcohol, and more especially the $C_9$–$C_{15}$ primary and secondary aliphatic alcohol ethoxylated with an average of from 1 to 10 moles of ethylene oxide per mole of alcohol.

Although the preferred nonionic surfactants are ethoxylated alcohols as detailed above, the invention is also applicable to non-ethoxylated nonionic surfactants, for example alkyl polyglycosides, glycerol monoethers, and polyhydroxy amides (glucamide).

The nonionic surfactant is preferably in the form of a liquid, viscous liquid or waxy material at ambient temperature.

The water level in the nonionic surfactant should desirably be sufficiently low to avoid the formation of a mesophase. Most commercially available nonionic surfactants, as supplied, satisfy this requirement. Preferably, the nonionic surfactant contains less than 5% by weight water, more preferably less than 2% by weight water.

Manufacture of the Nonionic-Surfactant-Containing Granular Composition

Typically the nonionic-surfactant-containing granular composition is made from a process which comprises (i) blending a nonionic surfactant with a water-insoluble liquid to produce an intimate blend, followed by (ii) mixing the intimate blend with a granular carrier material.

It is an essential feature of the present invention that the water-insoluble liquid be blended with the nonionic surfactant to provide an intimate blend, most preferably by mixing the nonionic surfactant and insoluble liquid together to form the intimate blend before preparing the granular composition. Such mixing may be carried out, for example, in a Sirman (Trade Mark) mixer.

It is preferred that step (ii), the addition of the surfactant/water-insoluble liquid blend to the carrier material, is carried out in a high speed mixer/granulator.

The porous granular carrier material may be manufactured by any suitable method, for example by preparing an aqueous slurry of carrier material components and spray-drying them in a spray-drying tower. Alternatively, a granulate may be prepared by granulating the carrier material in a high speed mixer/granulator, either continuous or batch, for example a Lödige (Trade Mark) CB Recycler (continuous) or a Fukae (Trade Mark) mixer (batch). It may be necessary to add a liquid in order to induce granulation of the powdered material from which the granulate is formed. The binder liquid may be water, or the nonionic surfactant may be added to the carrier components to act as a binder.

Other equipment suitable for use in the present invention include the Fukae mixer, produced by Fukae Powtech Co. of Japan, the Diosna V Series supplied by Dierks & Sohne Germany, the Pharma Matrix ex TK Fielder Ltd England, the Fuji V-C Series produced by Fuji Sangyo Company Japan and the Roto produced by Zanchetta & Company Srl, Italy. Other suitable equipment can include the Lödige Series CB for continuous high shear granulation available from Morton Machine Company, Scotland, and the Drais T160 Series manufactured by Drais Werke GmbH, Mannheim, Germany.

Detergent Compositions

The nonionic-surfactant-containing granular composition of the invention may form part of a particulate laundry detergent composition comprising from 5 to 60 wt % of surfactant, from 10 to 80 wt % of detergency builder and optionally other detergent ingredients, the composition being in the form of at least two particulate or granular components.

Thus the nonionic-surfactant-containing granular composition of the present invention may be mixed with other granular components to form a detergent composition, for example:

(a) a conventional spray-dried or agglomerated base powder granule containing anionic surfactant, builder and, optionally nonionic surfactant, and/or (b) a builder particle, and/or (c) a particle containing at least 50 wt %, preferably at least 60 wt %, of anionic surfactant.

The nonionic-surfactant-containing granular composition of the present invention may be mixed with conventional base powders in order to increase the nonionic surfactant content of the overall composition. Steps such as spraying nonionic surfactant onto base powder can then be reduced or avoided. High total quantities of nonionic surfactant in the mixture can be obtained. The nonionic-surfactant-containing granular composition of the present invention can be mixed with conventional base powders containing little or no nonionic surfactant or with builder granules.

The base powders or builder granules may be manufactured by any suitable process. For example, they may be produced by spray-drying, spray-drying followed by densification in a batch or continuous high speed mixer/densifier or by a wholly non-tower route comprising granulation of components in a mixer/densifier, preferably in a low shear mixer/densifier such as a pan granulator or fluidised bed mixer.

Preferably, the nonionic-surfactant-containing granular composition of the invention provides at least 40% by weight, preferably at least 50% by weight of the total composition.

The separately produced granular components may be dry-mixed together in any suitable apparatus.

The detergent compositions of the present invention may include additional powdered components dry-mixed with the granular component. Suitable components which may be post-dosed to the granular components will be discussed further below.

Other Detergent Ingredients

Detergent compositions according to the invention may also suitably contain a bleach system. It is preferred that the compositions of the invention contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates. Bleach ingredients are generally post-dosed as powders.

The peroxy bleach compound, for example sodium percarbonate, is suitably present in an amount of from 5 to 35 wt %, preferably from 10 to 25 wt %.

The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA) and the polyphos-phonates such as Dequest (Trade Mark), EDTMP. A bleach catalyst may also be included.

The detergent compositions of the invention may also contain alkali metal, preferably sodium, carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention. Sodium carbonate may be included in granular components, or post-dosed, or both.

The detergent composition may contain water-soluble alkali metal silicate, preferably sodium silicate having a $SiO_2$:$Na_2O$ mole ratio within the range of from 1.6:1 to 4:1. The water-soluble silicate may be present in an amount of from 1 to 20 wt %, preferably 3 to 15 wt % and more preferably 5 to 10 wt %, based on the aluminosilicate (anhydrous basis).

Other materials that may be present in detergent compositions of the invention include antiredeposition agents such as cellulosic polymers; soil release polymers; fluorescers; inorganic salts such as sodium sulphate; lather control agents or lather boosters as appropriate; proteolytic and lipolytic enzymes; dyes; coloured speckles; perfumes; foam controllers; and fabric softening compounds.

EXAMPLES

The present invention will be further described by way of the following non-limiting Examples. Except where stated otherwise, all quantities are in parts by weight.

Test Method (Flowcell) for Rate of Dispersion

The rate of dispersion is studied using an apparatus named a flowcell. A flowcell comprises a perspex container defining a flow path. The internal volume of the flow path is 4.5 $dm^3$ and has a depth of 2.5 cm. In use, the flowcell is illuminated so that the flow path can be visually inspected. For example, the flowcell may be viewed using a video camera or it may be placed on a microscope for microscopic viewing of particle dissolution. The flow channel in the flowcell is connected to a supply of water so that water can flow into the flowcell and out to a drain.

In the experiment, 1.0 g of powder was placed in a small heap in the flow passage in the flowcell. The powder bed was wetted for 60 seconds. This allows the bed to fuse together such that dispersion and not dispensing is monitored. Then, water was allowed to flow through the flowcell at a rate of 4.5 cm/second, giving an approximate Reynolds number of 400. The behaviour of the powder was then observed. The time required for all the powder to be removed by the flow of water was recorded.

Example 1 and Comparative Example A

For Example 1, a granular composition was manufactured by placing the nonionic surfactant and water-insoluble liquid in a hand operated mixer. The liquid components were mixed for 2 minutes to provide an intimate blend. Thereafter, 30 zeolite 4A was added and the three components were granulated for a further 10 minutes.

For Comparative Example A, the zeolite 4A and nonionic surfactant were granulated together. Thereafter the water-insoluble liquid was added and all three components were granulated for a further 10 seconds. In this procedure there was no intimate mixing of the nonionic surfactant and the water-insoluble liquid.

The inorganic carrier used was zeolite 4A (Wessalith (Trade Mark) ex Degussa). The nonionic surfactants used were $C_{12}$ 3EO (Dobanol (Trade Mark) 1-3, ex Shell) and $C_{12}$ 5EO (Dobanol (Trade Mark) 1-5, ex Shell). The water-insoluble liquid used was paraffin oil (ex Baker).

Both Example 1 and Comparative Example A had the following composition:

| Ingredient | Wt % |
|---|---|
| Zeolite 4A | 75 |
| $C_{12}$ 3EO | 6.25 |
| $C_{12}$ 5EO | 6.25 |
| Paraffin oil | 12.5 |

The powder samples of Example 1 and Comparative Example A (two samples of each) were subjected to a flowcell test to determine how quickly they dispersed in water. Dispersion times (minutes) were as follows:

| Example | First sample | Second sample | Average |
|---|---|---|---|
| 1 | 20 | 25 | 23 |
| A | No dispersion | No dispersion | No dispersion |

Accordingly, it can be seen that the powder according to the present invention dispersed, whereas in the comparative Example, where the water-insoluble liquid is not intimately mixed with the nonionic, did not disperse.

Examples 2 to 6, Comparative Examples B to D

These Examples show the critical importance of the presence of a water-insoluble liquid.

For Examples 2 to 6, a granular composition was manufactured by placing the nonionic surfactant and water-insoluble liquid in a hand operated mixer. The liquid components were mixed for 2 minutes. Thereafter, inorganic carrier material was added and the three components were granulated for a further 10 minutes.

For Comparative Examples B to D, inorganic carrier material and nonionic surfactant were granulated together. In this procedure there was no water-insoluble liquid mixed with the nonionic surfactant.

The inorganic carriers used were zeolite 4A (Wessalith (Trade Mark) ex Degussa) and zeolite MAP (Doucil (TradeMark) A24 ex Crosfield). The nonionic surfactants used were $C_{12}$ 3EO (Dobanol (Trade Mark) 1-3, ex Shell) and $C_{12}$ 5EO (Dobanol (Trade Mark) 1-5, ex Shell). The water-insoluble liquids used were a paraffin oil (ex Baker) and a hydrocarbon oil mixture of molecular weight 100 to 400 (Sirius M85 (Trade Mark) ex Silkolene).

The ingredients and average dispersion times (minutes) are shown in Table 1.

TABLE 1

| | 2 | B | 3 | 4 | C | 5 | 6 | D |
|---|---|---|---|---|---|---|---|---|
| Zeolite 4A | — | — | — | — | — | 75 | 75 | 75 |
| Zeolite A24 | 75 | 75 | 75 | 75 | 75 | — | — | — |
| $C_{12}$ 3EO | 12.5 | 25 | 6.25 | 6.25 | 12.5 | 6.25 | 6.25 | 12.5 |
| $C_{12}$ 5EO | — | — | 6.25 | 6.25 | 12.5 | 6.25 | 6.25 | 12.5 |
| Paraffin oil | 12.5 | — | 12.5 | — | — | 12.5 | — | — |
| Sirius m85* | — | — | — | 12.5 | — | — | 12.5 | — |
| Dispersion time | 45 | none | 25 | 30 | None | 25 | 22 | none |

*Trade Mark

Table 1 clearly shows the improvement in dispersion when the nonionic is intimately blended with the water-insoluble liquid.

Examples 7 to 9, Comparative Examples E and F

For Examples 7 to 9, the same experimental procedure was followed as for examples 2 to 6 above, however a shorter chain nonionic surfactant was used ($C_{10}$ 5EO, Neodol (Trade mark) 91-5, ex Shell).

For Comparative Examples E and F, the same experimental procedure was followed as for Comparative Examples B to D above. Again the shorter chain nonionic was used.

The inorganic carriers and water-insoluble liquid were those used in Examples 2 to 6.

The ingredients and average dispersion times (minutes) are shown in Table 2.

TABLE 2

| | 7 | E | 8 | 9 | F |
|---|---|---|---|---|---|
| Zeolite 4A | — | — | 75 | 75 | 75 |
| Zeolite MAP | 75 | 75 | — | — | — |
| $C_{10}$ 5EO | 12.5 | 25 | 12.5 | 17 | 25 |
| Paraffin oil | 12.5 | — | 12.5 | 8 | — |
| Dispersion time | 10 | none | 8 | 13 | 20 |

We claim:

1. A nonionic-surfactant-containing granular composition, comprising:

(a) from 5 to 60 wt % of an intimate blend consisting essentially of (i) a nonionic surfactant, and (ii) a water-insoluble liquid selected from paraffin wax, aromatic solvents, halogenated solvents, heterocyclic solvents, terpenes, and mineral oils, wherein the weight ratio of the nonionic surfactant (i) to the water-insoluble liquid (ii) is within the range of from 5:1 to 1:2, and (b) from 40 to 95 wt % of a granular carrier material.

2. A composition as claimed in claim 1, wherein the weight ratio of (a)(i) to (a)(ii) is within the range of from 4:1 to 1:1.

3. A composition as claimed in claim 1, wherein the composition comprises from 20 to 50 wt % of the intimate blend (a), and from 50 to 80 wt % of the granular carrier material (b).

4. A granular composition as claimed in claim 1, wherein the water-insoluble liquid (a)(ii) is a mineral oil.

5. A granular composition as claimed in claim 1, wherein the paraffin wax is selected from linear chain paraffins, branched chain paraffins and mixtures thereof.

6. A composition as claimed in claim 1, wherein the granular carrier material (b) is substantially or completely water-insoluble.

7. A composition as claimed in claim 1, wherein the granular carrier material (b) is selected from alkali metal aluminosilicates, silicas, silicates, clays and calcite.

8. A composition as claimed in claim 7, wherein the granular carrier material comprises a crystalline alkali metal aluminosilicate selected from zeolite A, zeolite MAP and mixtures thereof.

9. A composition as claimed in claim 7, wherein the granular carrier material comprises at least 76 wt %, preferably at least 80 wt %, of alkali metal aluminosilicate.

10. A composition as claimed in claim 7, wherein the granular carrier material consists essentially of alkali metal aluminosilicate.

11. A composition as claimed in claim 1, wherein the nonionic surfactant (a)(i) is in the form of a liquid, viscous liquid or waxy material at ambient temperature.

12. A composition as claimed in claim 1, wherein the nonionic surfactant (a)(i) is an ethoxylated alcohol.

13. A composition as claimed in claim 12, wherein the nonionic surfactant comprises a $C_8$–$C_{20}$ primary and secondary aliphatic alcohol ethoxylated with an average of from 1 to 20 moles of ethylene oxide per mole of alcohol.

14. A process for manufacturing a nonionic-surfactant-containing granular composition as claimed in claim 1, which process comprises:

(i) blending a nonionic surfactant with the water-insoluble liquid selected from paraffin wax aromatic solvents, halogenated solvents, heterocyclic solvents, terpenes, and mineral oils to produce the intimate blend, followed by (ii) mixing the intimate blend with the granular carrier material.

15. A process as claimed in claim 14, wherein the granular carrier material is produced by spray-drying an aqueous slurry of carrier material components.

16. A process as claimed in claim 14, wherein the granular carrier material is prepared by granulating carrier material in a high speed mixer/granulator.

17. A process as claimed in claim 14, wherein step (ii) is carried out in a high speed mixer/granulator.

18. A particulate laundry detergent composition comprising from 5 to 60 wt % of surfactant, from 10 to 80 wt % of detergency builder and optionally other detergent ingredients, the composition being in the form of at least two particulate or granular components of which at least one is a nonionic-surfactant-containing granular composition as claimed in claim 1.

19. A nonionic-surfactant-containing granular composition, comprising:

(a) from 5 to 60 wt % of an intimate blend consisting essentially of (i) a nonionic surfactant, and (ii) a water-insoluble liquid comprising a silicone oil, wherein the weight ratio of the nonionic surfactant (i) to the water-insoluble liquid (ii) is within the range of from 5:1 to 1:2, and (b) from 40 to 95 wt % of a granular carrier material.

20. A composition as claimed in claim 19, wherein the granular carrier material (b) is substantially or completely water-insoluble.

21. A composition as claimed in claim 19, wherein the granular carrier material (b) is selected from alkali metal aluminosilicates, silicas, silicates, clays and calcite.

22. A composition as claimed in claim 21 wherein the granular carrier material comprises a crystalline alkali metal aluminosilicate selected from zeolite A, zeolite MAP and mixtures thereof.

23. A composition as claimed in claim 21, wherein the granular carrier material comprises at least 76 wt %, preferably at least 80 wt %, of alkali metal aluminosilicate.

24. A composition as claimed in claim 21, wherein the granular carrier material consists essentially of alkali metal aluminosilicate.

25. A process for manufacturing a nonionic-surfactant-containing granular composition as claimed in claim 19, which process comprises:

(i) blending a nonionic surfactant with the water-insoluble liquid which is a silicone oil to produce the intimate blend, followed by (ii) mixing the intimate blend with the granular carrier material.

26. A process as claimed in claim 25, wherein the granular carrier material is produced by spray-drying an aqueous slurry of carrier material components.

27. A process as claimed in claim 25, wherein the granular carrier material is prepared by granulating carrier material in a high speed mixer/granulator.

28. A process as claimed in claim 25, wherein step (ii) is carried out in a high speed mixer/granulator.

* * * * *